US005689861A

United States Patent [19]

Petignat

[11] Patent Number: 5,689,861

[45] Date of Patent: Nov. 25, 1997

[54] STRAP CLASP

[75] Inventor: Maurice Petignat, La Chaux-De-Fonds, Switzerland

[73] Assignee: Etablissements Sarran S.A., France

[21] Appl. No.: 714,088

[22] PCT Filed: Mar. 21, 1995

[86] PCT No.: PCT/IB95/00194

§ 371 Date: Sep. 17, 1996

§ 102(e) Date: Sep. 17, 1996

[87] PCT Pub. No.: WO95/25447

PCT Pub. Date: Sep. 28, 1995

[30] Foreign Application Priority Data

Mar. 22, 1994 [CH] Switzerland ..... 860/94

[51] Int. Cl.[6] ..... A44C 5/20

[52] U.S. Cl. ..... 24/265 WS; 24/656; 24/265 EC; 24/265 B

[58] Field of Search ..... 24/265 WS, 265 B, 24/265 EC, 662–667, 625, 656, 685, 573.5, 584, 599.3

[56] References Cited

U.S. PATENT DOCUMENTS

| | | | |
|---|---|---|---|
| 2,713,445 | 7/1955 | Speck | 24/265 WS |
| 3,712,173 | 1/1973 | Savioli et al. | 24/265 B X |
| 3,824,783 | 7/1974 | Nadeau | 24/265 B X |
| 3,837,048 | 9/1974 | Lewis et al. | 24/265 B X |
| 3,889,323 | 6/1975 | Reith | 24/265 B |
| 3,939,534 | 2/1976 | Hayes | 24/265 B |
| 4,190,934 | 3/1980 | Wildi | 24/265 B X |
| 4,564,308 | 1/1986 | Ikegami et al. | 24/265 B X |
| 4,675,955 | 6/1987 | Nakamura | 24/265 WS X |
| 5,191,685 | 3/1993 | Aoki et al. | 24/265 WS X |
| 5,305,503 | 4/1994 | Yamagata | 24/265 WS X |
| 5,313,691 | 5/1994 | Hashimoto | 24/265 WS X |

FOREIGN PATENT DOCUMENTS

| | | | |
|---|---|---|---|
| 461675 | 12/1991 | European Pat. Off. | 24/265 WS |
| 239016 | 12/1945 | Switzerland | 24/265 B |
| 667979 | 11/1988 | Switzerland | 24/265 WS |
| 668353 | 12/1988 | Switzerland | 24/265 WS |
| 670941 | 7/1989 | Switzerland | 24/265 WS |

*Primary Examiner*—Peter M. Cuomo
*Assistant Examiner*—Robert J. Sandy
*Attorney, Agent, or Firm*—Silverman, Cass & Singer, Ltd.

[57] ABSTRACT

A clasp with a locking flap (8) hingedly mounted between the arms (3*a*, 3*b*) of a yoke-shaped member (3) by means of a pin (9) extending through one portion (8*a*) of said flap (8). Said portion (8*a*) is shorter than the distance between the two arms (3*a*, 3*b*) so that the flap (8) is transversely translatable. The pin (9) has a straight portion (9*c*) partially inserted into a correspondingly shaped recess (13) in one arm (3*b*). The pin (9) is thus prevented from rotating about its own axis. The passage (14) in said portion (8*a*) of the flap which receives the pin (9) has an inlet (14*a*) shaped to fit said portion (9*c*) of the pin (9). A coil spring (15) on the pin (9) biases the flap (8) towards said portion (9*c*) of the pin (9). When the flap (8) is in the folded down or locking position, said portion (9*c*) of the pin (9) is inserted into the inlet (14*a*) of the passage (14), thereby locking the flap (8).

4 Claims, 2 Drawing Sheets

FIG. 3
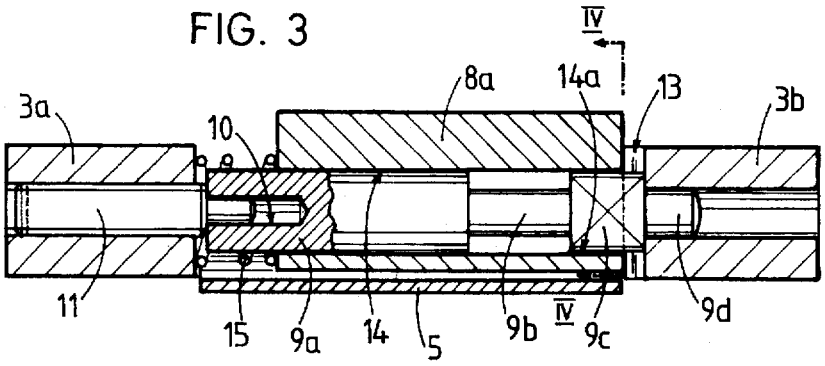
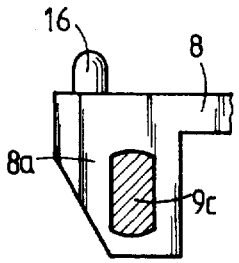
FIG. 4
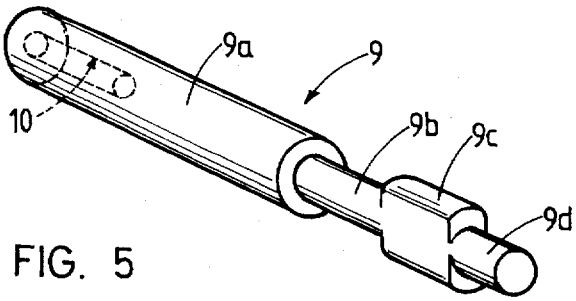
FIG. 5
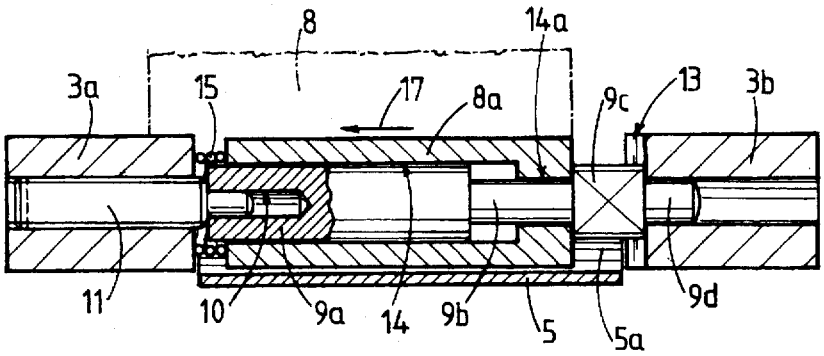
FIG. 6

STRAP CLASP

The present invention relates to a strap clasp provided with a locking device comprising a locking member articulated on the body of the clasp around a transversal axis, and which is able to occupy two positions, one, turned up, in which the clasp is unlocked, and the other one, turned down, in which the clasp is locked.

Clasps as hereabove mentioned are known per se. They are used for several applications, especially for the closing of straps for watches.

In these known clasps, the articulated locking member is, in most of the cases, constituted by a flap hold in its turned down position, of locking, by means of a protrusion which is resiliently deformable, of the flap and which is snapped to another element of the clasp. Such an arrangement does not exclude the risk of an undesired unlocking of the clasp.

The object of the present invention is to furnish means for maintaining the articulated locking member in a locking position which reduces the risks of an undesired unlocking.

This object is achieved by means as claimed in claim 1.

The drawing shows, by way of example, one embodiment of the object of the invention.

FIG. 3 is a sectional view on the line III—III of FIG. 2.

FIG. 4 is a sectional view on the line IV—IV of FIG. 3.

FIG. 5 is a perspective view of a detail of this clasp, and

FIG. 6 is a sectional view similar to this of FIG. 2, the locking member of the clasp occupying its turned up position, of unlocking.

Figure 1:
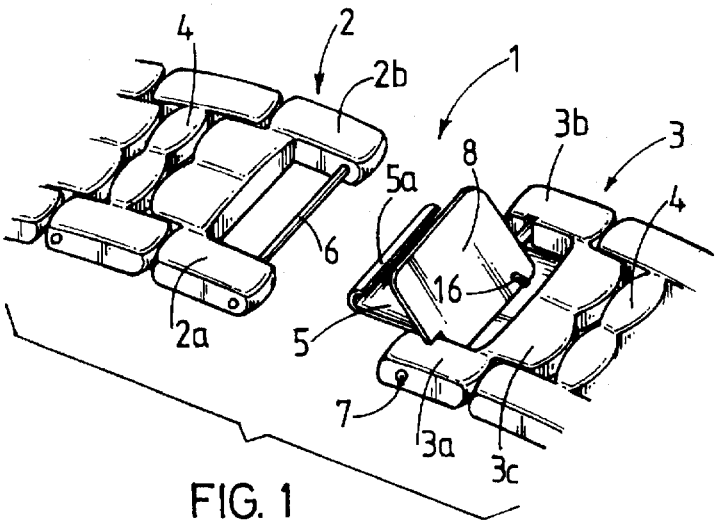
FIG. 1 is a perspective view of a clasp for watchstrap in its open position.

The clasp illustrated is generally designated by reference 1. It comprises two stirrup shaped members 2 and 3 between the arms 2*a* and 2*b*, respectively 3*a* and 3*b* of which are articulated the ends of the two parts 4 of a strap. The stirrup shaped member 3 carries, secured to its transversal portion, designated by 3*c*, by soldering for instance, a longitudinal small plate 5 the end of which is turned up at 5*a* in the shape of a gutter. This turned up portion 5*a* constitutes a hook intended to be hooked, when the clasp is closed, to a transversal small bar 6 disposed between the arms 2*a* and 2*b* of the stirrup shaped member 2.

The stirrup shaped member 3 carries, articulated thereon at 7 (FIG. 1), a hooking flap 8 intented to occupy a turned up position, represented in FIG. 1, in which the clasp is unlocked and a turned down position in which it closes the hook 5*a*, preventing the latter from releasing the transversal small bar 6.

The locking flap 8 is articulated between the arms 3*a* of the stirrup shaped member 3 by means of a shaft 9 represented in perspective in FIG. 5. This shaft is provided with a section 9*a* provided with a blind hole 10 in which engages the end of a screw 11 which is screwed in the arm 3*a* of the member 3. This screw 11 is itself locked by a screw 12 screwed in the arm 3*a*. The shaft 9 is prolongated by a section 9*b* of a smaller diameter, followed by a portion 9*c*, the shape of the cross-section of which is not circular (FIGS. 4 and 5), this portion 9*c* being itself followed by a terminal portion 9*d* engaging the second arm, 3*b*, of the member 3.

This second arm 3*b* is provided, on its inner face opposite the portion 9*c* of the shaft 9, witha milling 13 the width of which corresponds to this one of the portion 9*c*, in which is engaged the end of this portion 9*c* under the effect of the axial pushing exerted by the screw 11 on the shaft 9. It results from the engagement of the portion 9*c* of the shaft 9 with the milling 13 that the shaft 9 is prevented from rotating on itself.

Figure 2:
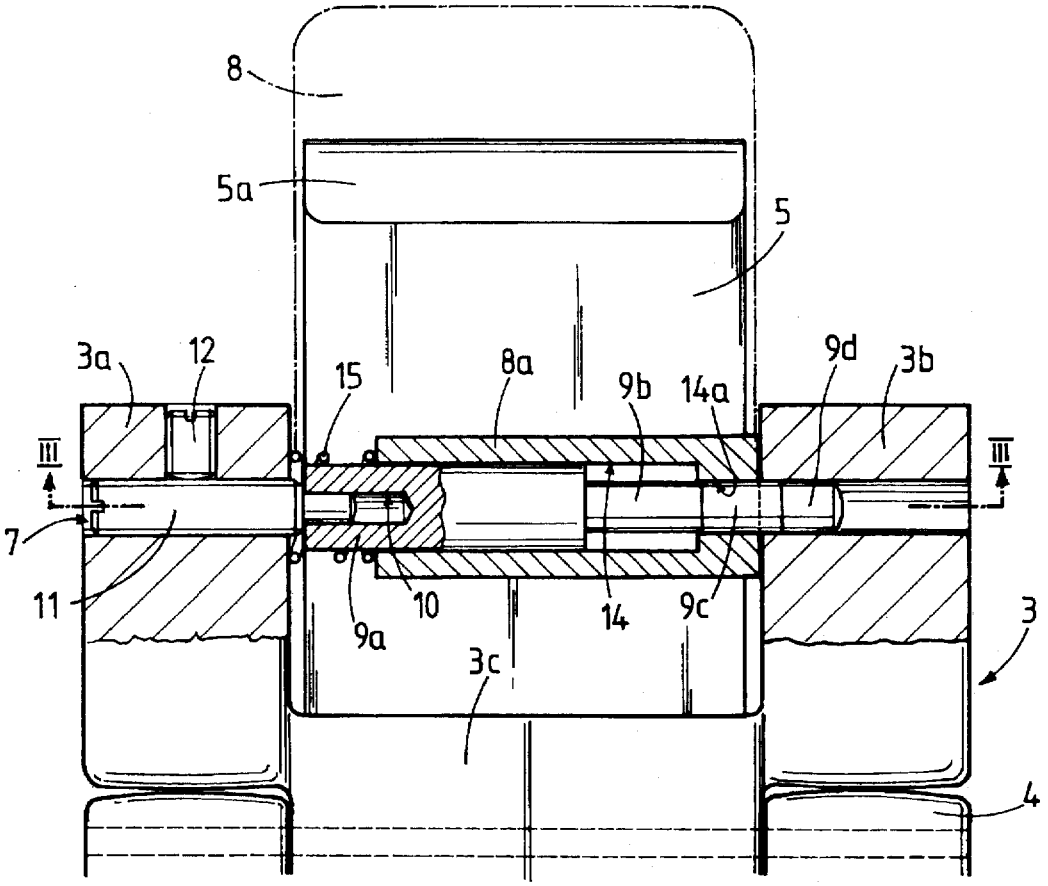
FIG. 2 is a sectional view of this clasp to an enlarged scale, passing through the articulation axis of the locking member, the latter being in its turned down position of locking.

The locking flap 8 is provided, along its rear edge, with a transversal portion 8*a*, which is thicker (FIG. 4), constituting a sleeve provided with a passage 14 traversed by the shaft 9. The length of this portion 8*a* is shorter than the distance separating the two arms 3*a* and 3*b* of the stirrup shaped member 3, so that the flap 8 can effect, besides its rotative locking movement around the shaft 9, a translation movement along this shaft. The end of the passage 14 situated opposite the arm 3*b* of the member 3 is provided, seen from the end, at 14*a*, with an opening portion the shape of which corresponds to the shape of the portion 9*c* of the shaft 9. At last, a coil spring 15, engaged on the end of the section 9*a* of the shaft 9, bears on the one hand on the arm 3*a* of the member 3 and on the other hand on the end of the sleeve 8*a* of the flap 8. This coil spring urges the flap 8 towards the right side of FIGS. 2, 3 and 6.

When the flap occupies his turned up position, in which it closes the hook 5*a*, the opening section 14*a* of the passage 14 is orientated, with respect to the shaft 9, in such a way that the portion 9*c* can engage the recess constituted by the opening 14*a*, that locks the flap 8 in its locking position, the shaft 9 being not able to rotate on itself.

When the user of the clasp acts on a pin 16 (FIG. 1) carried by the flap 8, for instance by means of one of his finger-nails, he can move the flap along the shaft 9, in the direction of the arrow 17 of FIG. 6, against the action of the return spring 15, thus bringing the portion 9*c* of the shaft 9 out from the recess 14*a*. The flap 8 can then be turned up and brought into the position represented in FIG. 1 in which the clasp is unlocked.

Owing to the arrangement as disclosed and represented, the flap 8 is perfectly locked in its turned down position, of locking, without risk of an undesired unlocking.

As a modification, the articulated locking member could present a shape different from a flap.

As a modification also, one could provide the case where the portion 8*a* of the flap would present a protrusion or a recess of a shape corresponding to a recess or to a protrusion of the inner face of the arm 3*b* of the stirrup shaped member 3.

It is to be noted that, in the example as disclosed and represented, the articulation shaft 9 of the flap 8 is held in position by a screw 11. One could however provide the case where this shaft could be held in position on the stirrup shaped member 3 by a device such as the one object of the Swiss Patent No 674.759 and of the corresponding European Patent No 0 373 184, both in the name of the same owners.

At last, the invention is not restricted to its application to watch clasps, as disclosed and represented, but could be applied to any strap, especially to belts, waistbands, and others.

I claim:

1. A strap clasp movable between an open and a closed position comprising, the clasp having a longitudinal axis, a locking member articulated around an articulation shaft which is positioned transverse to the longitudinal axis of the clasp, said locking member movable between a first turned up rest position and a second turned down working position, the locking member maintaining the clasp in its closed position when the locking member is in said working position, the locking member being operable to effect a translation movement parallel to said articulation shaft, a resilient return member associated with said locking member for said translation movement, said return member urging upon the locking member to maintain the locking member in said working position, said articulation shaft including a section of non-circular cross-sectional configuration, the locking member including a passageway for receiving said articulation shaft, said passageway having an ending portion of cross-sectional configuration which is substantially the same as the non-circular cross sectional configuration of the articulation shaft, whereby the ending portion of the passageway is engaged by the non-circular section of the articulation shaft when the locking member is in said working position.

2. A clasp as claimed in claim 1 in which the shaft is prevented from rotating when the no-circular section of the shaft is engaged within the passageway.

3. A clasp as claimed in claim 1 in which the clasp includes a body, said body having a generally stirrup shaped member with a pair of spaced apart arms, said locking member being articulated between said arms, the locking member having a portion which is engaged upon the articulation shaft, said last named portion having a length which is shorter than the distance separating said arms to permit the locking member to be moved in a movement of translation along said articulation shaft, said resilient member being a coil spring interposed between one of said arms and an end of said shaft which is spaced from the non-circular section thereof, said spring urging the non-circular section of the shaft into the ending portion of the passageway.

4. A clasp as claimed in claim 1 in which the locking member includes a flap, said flap being engageable by a user to move the locking member from its working position against the action of said resilient return member to disengage the section of non-circular configuration of the articulation shaft from the passageway.

* * * * *